US010008173B2

(12) United States Patent
Wei et al.

(10) Patent No.: US 10,008,173 B2
(45) Date of Patent: Jun. 26, 2018

(54) LIQUID CRYSTAL DISPLAY DEVICE WITH A DISCHARGE CONTROL CIRCUIT

(71) Applicant: HON HAI PRECISION INDUSTRY CO., LTD., New Taipei (TW)

(72) Inventors: Fu-Cheng Wei, Tu-Cheng (TW); Hsin-Hua Lin, Tu-Cheng (TW); Feng-Hsiang Liu, Tu-Cheng (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 300 days.

(21) Appl. No.: 14/940,803

(22) Filed: Nov. 13, 2015

(65) Prior Publication Data

US 2017/0092218 A1 Mar. 30, 2017

(30) Foreign Application Priority Data

Sep. 30, 2015 (TW) ..... 104131972 A

(51) Int. Cl.
*G09G 3/36* (2006.01)

(52) U.S. Cl.
CPC ..... *G09G 3/3696* (2013.01); *G09G 3/3648* (2013.01); *G09G 2300/0404* (2013.01); *G09G 2300/0426* (2013.01); *G09G 2300/0478* (2013.01); *G09G 2330/02* (2013.01); *G09G 2330/027* (2013.01)

(58) Field of Classification Search
None
See application file for complete search history.

(56) References Cited

U.S. PATENT DOCUMENTS

2004/0130543 A1* 7/2004 Sun ..... G09G 3/3648 345/211
2005/0253832 A1 11/2005 Chung
2008/0165101 A1* 7/2008 Kim ..... G09G 3/3696 345/87
2008/0180429 A1* 7/2008 Park ..... G09G 3/3648 345/211
2013/0147697 A1* 6/2013 Sung ..... G02F 1/136204 345/87

* cited by examiner

*Primary Examiner* — David Donald Davis
(74) *Attorney, Agent, or Firm* — ScienBiziP, P.C.

(57) ABSTRACT

A liquid crystal display device capable of being grounded to avoid afterimages includes a liquid crystal panel, a time controller, a gate driver, a data driver, a common voltage generating circuit, and a discharging circuit. The liquid crystal panel includes a plurality of pixel electrodes and a plurality of common electrodes. The pixel electrodes and common electrodes cooperate with each other to form a liquid crystal capacitor. In a power off process, the discharging circuit of the display controls the gate driver to stop generating grayscale voltages and grounds the common voltage generating circuit to discharge the liquid crystal capacitor.

7 Claims, 5 Drawing Sheets

LIQUID CRYSTAL DISPLAY DEVICE WITH A DISCHARGE CONTROL CIRCUIT

CROSS-REFERENCE TO RELATED APPLICATIONS

This application claims priority to Taiwanese Patent Application No. 104131972 filed on Sep. 30, 2015, the contents of which are incorporated by reference herein.

FIELD

The subject matter herein generally relates to a liquid crystal displays.

BACKGROUND

Metal-oxide thin film transistors which are used in liquid crystal display devices can include a channel layer made of metal-oxide semiconductor. A leakage current of the metal-oxide thin film transistor will cause afterimages.

BRIEF DESCRIPTION OF THE FIGURES

Implementations of the present technology will now be described, by way of example only, with reference to the attached figures.

DETAILED DESCRIPTION

Figure 1:
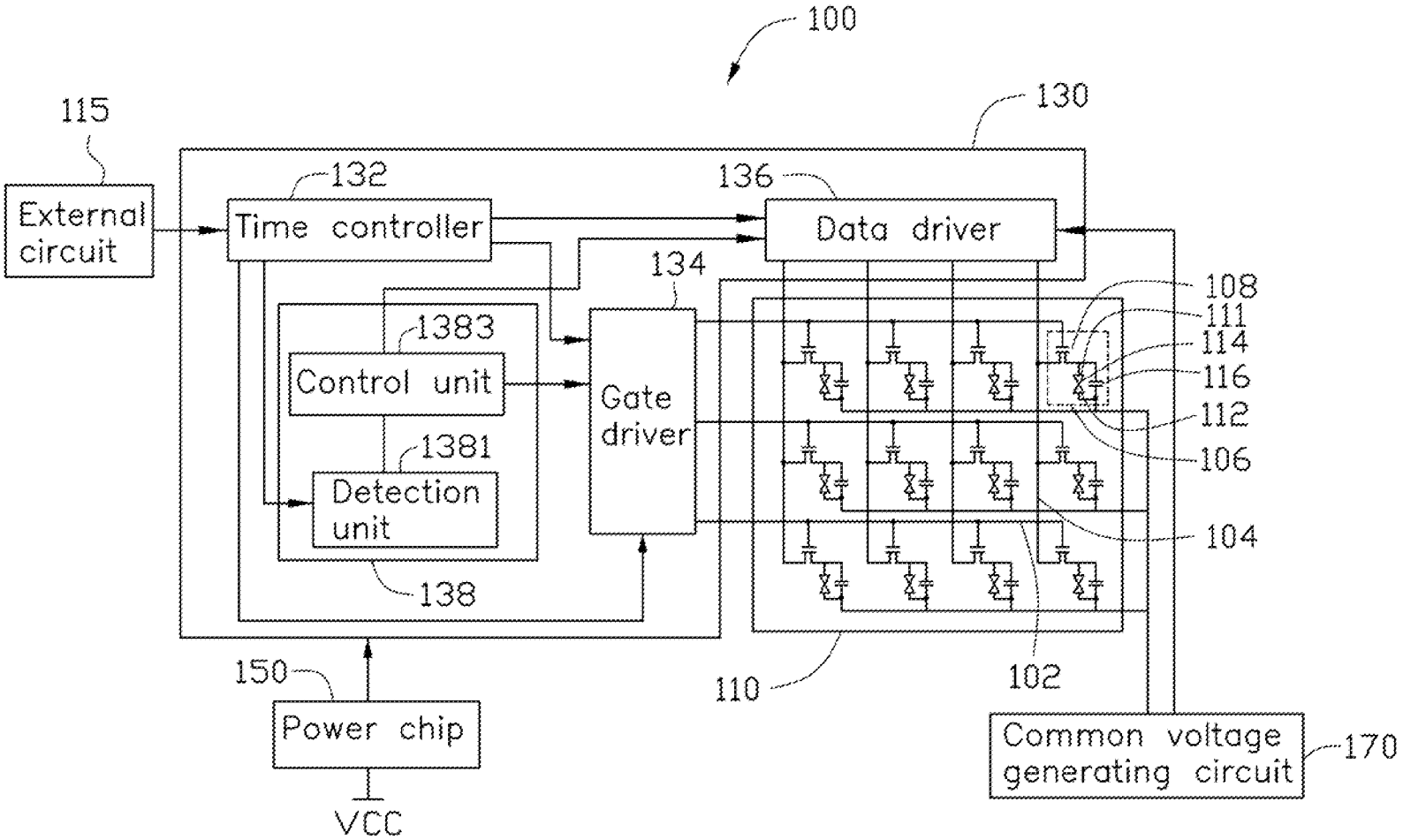
FIG. 1 is an isometric view of an embodiment of a liquid crystal display device, the liquid crystal display device comprising a discharge control circuit.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" means "including, but not necessarily limited to"; it specifically indicates open-ended inclusion or membership in a so-described combination, group, series, and the like.

FIG. 1 illustrates an embodiment of a liquid crystal display device 100. The liquid crystal display device 100 includes a liquid display panel 110, a driving circuit 130 for driving the liquid display panel 110, a power chip 150 for providing working voltages to the driving circuit 130, and a common voltage generating circuit 170 for providing a common voltage to the liquid display panel 110. In at least one embodiment, the liquid crystal display device 100 is a normal black type liquid crystal display device. The power chip 150 is electrically connected to an external voltage VCC as a power supply.

The liquid display panel 110 includes a plurality of scan lines 102, a plurality of data lines 104 insulated from the scan lines 102, a plurality of thin film transistors (TFTs) 108, a plurality of pixel electrodes 111, a plurality of common electrodes 112, and a plurality of storage capacitors 116. The scan lines 102 and the date lines 104 cross each other and define a plurality of pixels 106. The TFTs 108 are located at intersections of the scan lines 102 and the data lines 104. The pixel electrodes 111 are located at intersections of the scan lines 102 and the data lines 104. A pixel electrode 111, a corresponding common electrode 112, and liquid crystal molecules therebetween (not shown) cooperate with each other to form a liquid crystal capacitor 114. The liquid crystal capacitor 114 is electrically connected with the storage capacitor 116 in parallel. A gate electrode (not labeled) of the TFT 108 is electrically connected to the a scan line 102, a source electrode (not labeled) of the TFT 108 is electrically connected to a data line 104, and a drain electrode (not labeled) of the TFT 108 is electrically connected to a pixel electrode 111. The common electrode 112 is electrically connected to the common voltage generating circuit 170 via a common electrode line 118.

The driving circuit 130 includes a time controller 132, a gate driver 134, a data driver 136, and a discharging circuit 138. The time controller 132 receives image data from an external circuit 115, and can generate time signals to the gate driver 134 and the data driver 136. The time controller 132 can also generate data signals to the data driver 136 based on the received image data. The gate driver 134 generates pulses to the scan lines 102 in response to the controller signals. The data driver 136 can transform the received data signals into grayscale voltages in response to a data signal and a time controller signal. The discharging control circuit 138 is electrically connected to the time controller 132, the gate driver 134, and the data driver 136. The discharging control circuit 138 can be controlled by the time controller signal generated by the time controller 132. The discharging control circuit 138 includes a detection unit 1381 and a control unit 1383. The detection unit 1381 can detect a decrease in the external voltage VCC. The control unit 1383 can generate different control signals to the gate driver 134, the data driver 136, the common voltage generating circuit 170, and the power chip 150 based on a detected decrease in voltage VCC. In at least one embodiment, the time controller 132 can output a clock signal CLK, a driving control signal DCC, and a gate driving control signal GDC. The time controller 132 outputs the clock signal CLK to the gate driver 132 and the data driver 136.

Figure 2:
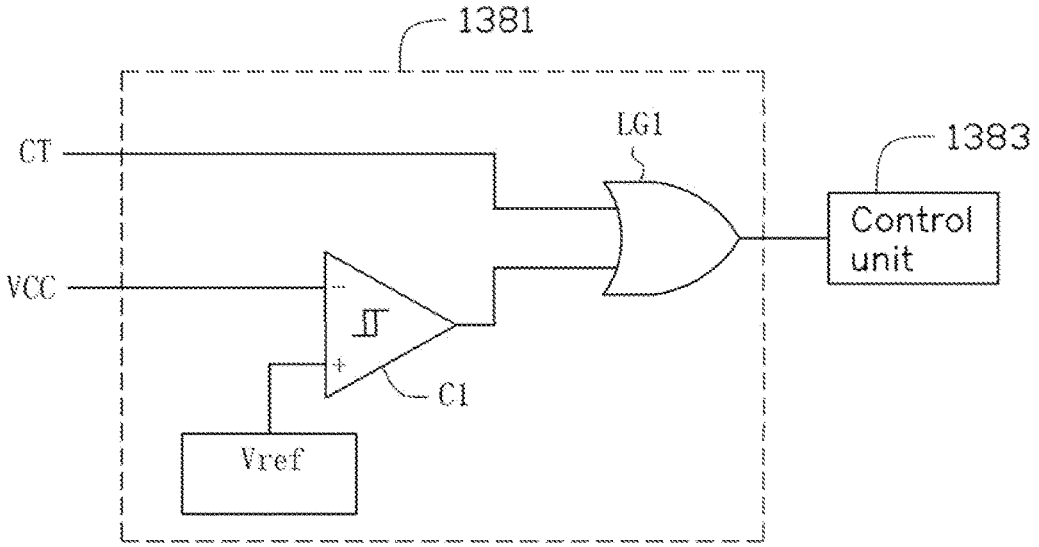
FIG. 2 is a circuit diagram view of the discharge control circuit of FIG. 1.

FIG. 2 illustrates the discharging control circuit 138. The detection unit 1381 includes a comparator C1 and an OR gate LG1. A positive input terminal of the comparator C1 is electrically connected to a reference voltage Vref, an inverting input terminal of the comparator C1 is electrically connected to the external voltage VCC, and an output terminal of the comparator C1 is electrically connected to a first input terminal of the OR gate LG1. A second input terminal of the OR gate LG1 is electrically connected to the control signal CT of the time controller 132, and an output terminal of the OR gate LG1 is electrically connected to the control unit 1383.

Figure 3:
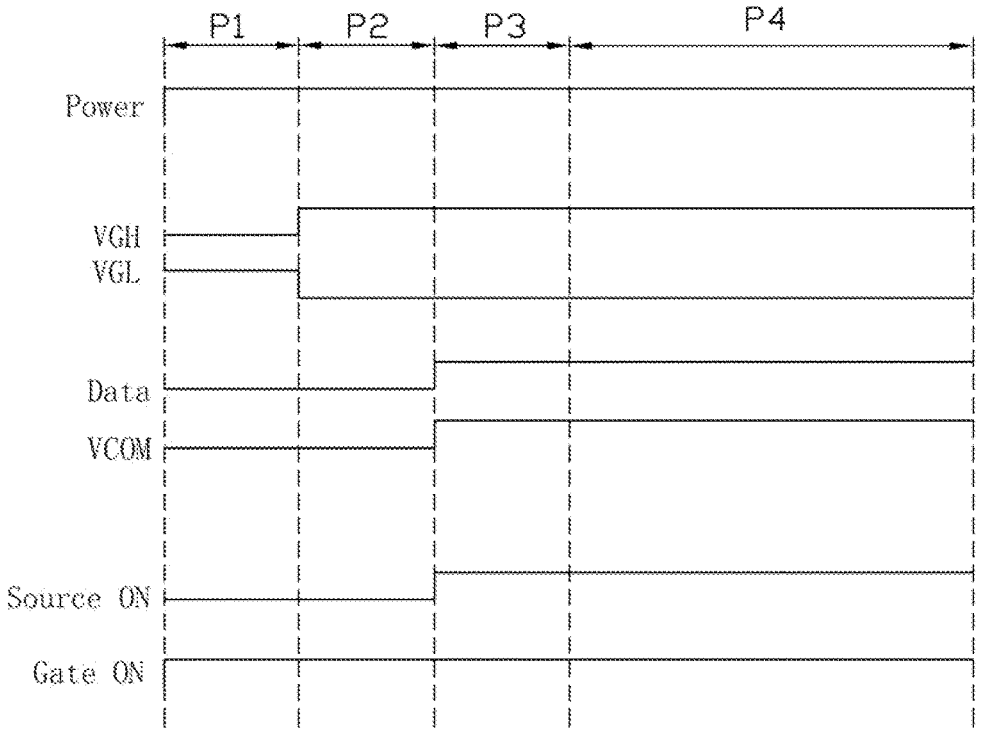
FIG. 3 is a diagrammatic view of waveforms of the liquid crystal display device of FIG. 1 in a power-on process.

FIG. 3 illustrates waveforms of the liquid crystal display device 100 in a power-on process. In a first time period P1 of the power-on process, the power signal Power is provided by the power chip 150. The gate driver 134 receives a turn-on signal VGH in a logic low signal and a turn-off signal VGL in a logic high signal, VGH and VGL being provided by the time controller 132. No data signal is generated by the data driver 136, and no voltage is generated by the common voltage generating circuit 170. The voltage of the inverting terminal of the comparator C1 is sharply increased to be equal to or more than the reference voltage Ref based on the external voltage VCC, which causes the output terminal of the comparator C1 to output a first control signal. The OR gate LG1 controls the control unit 1383 to output a Gate ON signal to the gate driver 134 and a Source ON signal to the data driver 136 in response to the first control signal. In at least one embodiment, the first time period P1 is in a range between 100-200 milliseconds.

In a second time period P2 of the power-on process, the gate driver 134 outputs the turn-on signal VGH in a logic low signal and the turn-off signal VGL in a logic high signal based on the Gate ON signal. The TFTs 108 are all turned on simultaneously, which causes the pixel electrodes 111 to discharge. No voltage is generated by the common voltage generating circuit 170, and the common voltage generating circuit 170 itself discharges via the common electrode lines 118.

In a third time period P3 of the power-on process, the common voltage generating circuit 170 outputs the common voltage to the common electrode lines 118. The time controller 132 controls the liquid crystal display device 100 to display a black display.

In a fourth time period P4 of the power-on process, the time controller 132 receives the image data provided by the external circuit 115, and outputs the time controller signals and the data signals based on the image data, the data driver 136 outputting the data signals to the TFTs 108.

Figure 4:
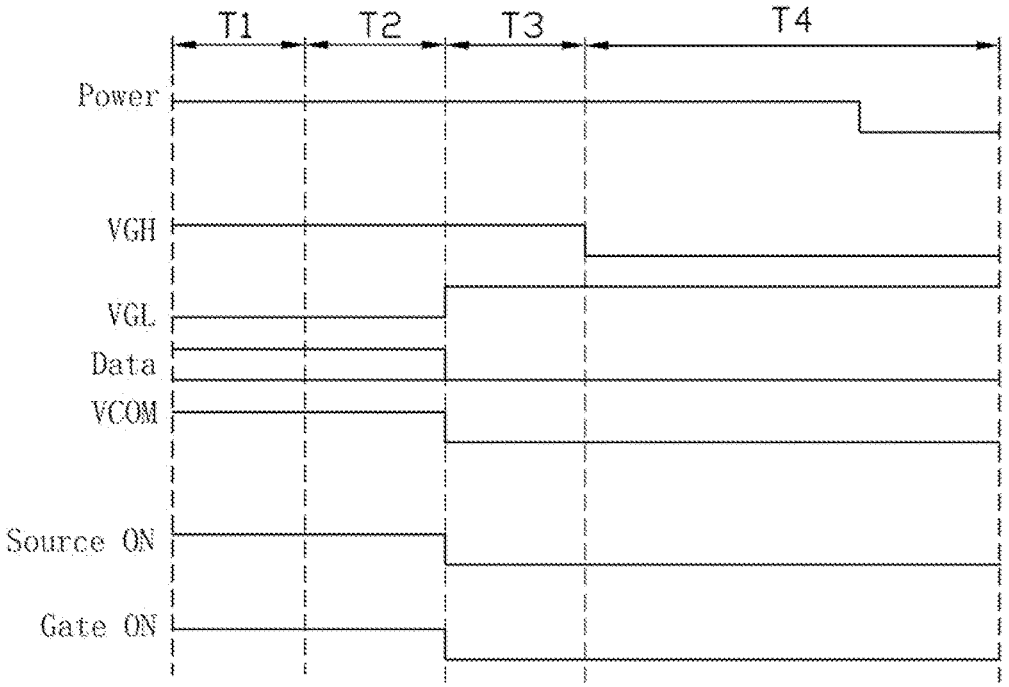
FIG. 4 is a diagrammatic view of waveforms of the liquid crystal display device of FIG. 1 in a power-off process.

FIG. 4 illustrates waveforms of the liquid crystal display device 100 in a power-off process. In a first time period P1 of the power-off process, the liquid crystal display device 100 displays normal status. In a second time period P2 of the power-off process, the power chip 150 and the common voltage generating circuit 170 still work based on a stored voltage. The reference voltage Vref continues for the moment, but the external voltage VCC decreases to be lower than the reference voltage Vref, which causes the comparator C1 to output a second control signal. The OR gate LG1 controls the control unit 1383 to output the Gate ON signal to the gate driver 134 and Source ON signal to the data driver 136. The data driver 136 outputs the black display data signal for controlling the liquid crystal display device 100 to display black. The turn-on signal VGH generated by the gate driver 134 is in a logic high signal, and the turn-off signal VGL generated by the gate driver 134 is in a logic low signal. The common voltage generating circuit 170 keeps outputting the common voltage Vcom.

In the third time period P3 of the power-off process, the turn-off signal VGL is in a logic high signal, and the common voltage generating circuit 170 stops generating the common voltage Vcom. The discharging circuit 138 outputs the Source ON signal in a logic low signal, which causes the data driver 136 to stop outputting any data signal. The discharging circuit 138 outputs the Gate ON signal in a logic low signal. Thus, the liquid capacitor 114 fully discharges via the common electrode lines 118.

In the fourth time period P4 of the power-off process, the power signal Power of the power chip 150 becomes zero.

Figure 5:
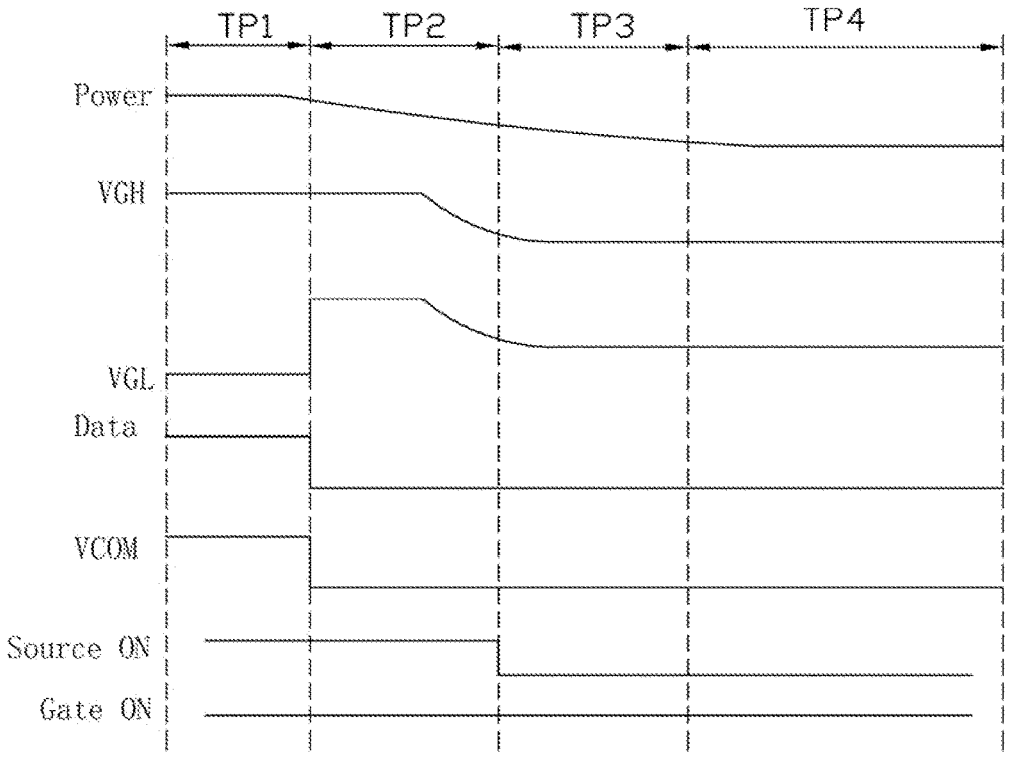
FIG. 5 is a diagrammatic view of waveforms of the liquid crystal display device of FIG. 1 in a cutoff process.

FIG. 5 illustrates waveforms of the liquid crystal display device 100 in a cutoff process. In a first time period TP1 of the power-off process, the power signal Power is gradually decreased, the reference voltage Vref is in the normal state, and the external voltage VCC decreases sharply to be lower than the reference voltage Vref. This causes the comparator C1 to output the second control signal. The OR gate LG1 controls the control unit 1383 to output the Gate ON signal to the gate driver 134 and the Source ON to the data driver 136. The turn-on signal VGH generated by the gate driver 134 is in a logic high signal, and the turn-off signal VGL generated by the gate driver 134 is in a logic low signal.

In a second time period TP2 of the cutoff process, the power signal of the power chip 150 keeps decreasing. The turn-off signal VGL generated by the gate driver 134 is in a logic high signal, and the turn-on signal VGH generated by the gate driver 134 decreases gradually. The common voltage generating circuit 170 stops outputting the common voltage Vcom. Thus, the liquid crystal capacitor 114 can fully discharge.

In the third time period TP3 of the cutoff process, the Source ON signal is switched to a logic low signal, and the power signal Power of the power chip 150 keeps decreasing.

In the fourth time period TP4 of the cutoff process, the power signal Power of the power chip 150 becomes zero, and the liquid crystal display device 100 is powered off.

The discharging circuit of the liquid crystal display device 100 enables the common electrode lines to be fully discharged by being grounded, and a display performance of the liquid crystal display device 100 is improved.

While various exemplary and preferred embodiments have been described, the disclosure is not limited thereto. On the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A liquid crystal display device comprising:

a liquid crystal panel comprising:

a plurality of pixel electrodes;

a plurality of common electrodes wherein each of the pixel electrodes and a corresponding common electrode cooperate with each other to form a liquid crystal capacitor; and a plurality of common electrode lines configured to be connected to corresponding ones of the plurality of common electrodes;

a time controller configured to receive image data and generate time controller signals and data signals;

a gate driver configured to output a series of pulses to a plurality of scan lines in response to the corresponding time controller signal from the time controller;

a data driver configured to receive the data signal and the corresponding time controller signals from the time controller and output a gray voltage when a corresponding TFT turns on;

a common voltage generating circuit configured to generate common voltages to the plurality of common electrodes via the common electrode lines; and a discharging circuit, wherein when the liquid crystal display device powers off, the discharging circuit controls the gate driver to stop generating the gray voltage and the common voltage generating circuit to be grounded for discharging the liquid crystal capacitor; the discharging circuit is electrically connected to the time controller, the gate driver, and the data driver; the discharging circuit comprises a detection unit and a control unit; the detection unit detects whether an external voltage decreases; the control unit controls the generates different control signal to the gate driver, the data driver, the common voltage generating circuit based on the detection result, the detection unit comprises a comparator and an OR gate; a positive input terminal of the comparator is electrically connected to a reference voltage; an invert input terminal of the comparator is electrically connected to the external voltage, and an output terminal of the comparator is electrically connected to a first input terminal of the OR gate; a second input terminal of the OR gate is electrically connected to the control signal of the time controller, and an output terminal of the OR gate is electrically connected to the control unit.

2. The liquid crystal display device of claim 1, wherein when the liquid crystal display device is in a powers off process, the reference voltage keeps in the normal state in a moment, the external voltage decreases to be lower than the reference voltage which causes the control unit to control the data driver to output a black image and the common voltage generating circuit to generate the common voltage based on the detection result.

3. The liquid crystal display device of claim 2, wherein the gate driver outputs a turn-on signal in a logic high signal and a turn-off signal in a logic low signal.

4. The liquid crystal display device of claim 3, wherein when the turn-off signal switches into a logic high signal, the common voltage generating circuit stops generating the common voltage, and the data driver stops generating the data signal; the liquid crystal capacitor fully discharges via the common electrode lines.

5. The liquid crystal display device of claim 1, wherein a power chip connected to the liquid crystal display device for providing power signal; when the liquid crystal display device is in a cutoff process, the power signal is gradually decreased, the reference voltage keeps in the normal state in a moment, the external voltage decreases to be lower than the reference voltage which causes the control unit to control the data driver to output a black image and the common voltage generating circuit to generate the common voltage based on the detection result.

6. The liquid crystal display device of claim 5, wherein the gate driver outputs a turn-on signal in a logic high signal and a turn-off signal in a logic low signal.

7. The liquid crystal display device of claim 6, wherein the turn-on signal decreases gradually; the common voltage generating circuit stops outputting the common voltage, and the liquid crystal capacitor fully discharges.

* * * * *